United States Patent [19]

Murray

[11] Patent Number: 4,491,724

[45] Date of Patent: Jan. 1, 1985

[54] COURSE AND HEADING COMPUTER

[76] Inventor: Robert F. Murray, 6 Arnold Rd., Shrewsbury, Mass. 01545

[21] Appl. No.: 383,525

[22] Filed: Jun. 1, 1982

[51] Int. Cl.[3] ..... G06C 3/00

[52] U.S. Cl. ..... 235/88 N; 235/61 NV; 235/78 N; 33/431

[58] Field of Search ..... 235/61 NV, 78 N, 88 N, 235/65, 83, 84, 89 R, 61 B, 61 GM; 33/431

[56] References Cited

U.S. PATENT DOCUMENTS

| | | | |
|---|---|---|---|
| 2,481,846 | 9/1949 | King | 235/83 |
| 2,904,885 | 9/1959 | Wood, Sr. | 235/61 NV |
| 3,018,552 | 1/1962 | Adams | 33/1 |
| 3,034,713 | 5/1962 | Kuzenko | 235/78 N |
| 3,076,596 | 2/1963 | Jaderholm | 235/84 X |
| 3,131,858 | 5/1964 | Warner | 235/61 NV |
| 3,350,007 | 10/1967 | Urben | 235/88 N |
| 4,359,628 | 11/1982 | Lambert | 235/61 NV |

*Primary Examiner*—Benjamin R. Fuller
*Attorney, Agent, or Firm*—Lahive & Cockfield

[57] ABSTRACT

A course and heading computer for use with marine charts which includes a transparent planar baseplate having a semicircular edge at one end joined with rectangular edges at the opposite end, the straightedge parallel to the shorter dimension of the baseplate being equal in length to the diameter of the semicircle, a 360° circular scale imprinted on the baseplate with its center at the center of the semicircle, and a printed scaled grid to assure quick, accurate alignment, on the marine charts, and a transparent disk member rotatably attached at its center to the center of said semicircle, and having a 360° scale imprinted around its periphery, the scale imprinted on the baseplate and the scale printed on the disk member being concentric with one another to form a compass rose, the zero degree point of the base member scale being located half way around the perimeter of the semicircle, and a bar member rotatably attached at its center to the center of the baseplate semicircle, where the bar member overlies the transparent disk, the bar member having an axial line inscribed thereon.

3 Claims, 2 Drawing Figures

COURSE AND HEADING COMPUTER

BACKGROUND OF THE INVENTION

This invention relates in general to a navigational aid computer for plotting courses on marine charts.

As is well known, conventional marine charts include a rectangular grid representing meridians of longitude and parallels of latitude with the meridians of longitude oriented to the true north direction. However, a marine navigator usually employs magnetic compass headings as the chief guide to maintaining the vessel on course. Since the variation between true north and magnetic north varies as a function of latitude, the variation for any particular area is imprinted on the chart. This is done in the form of a "compass rose" which includes two concentric circular scales divided into 360° marks, the outer one being oriented to true north at zero degrees with the inner one being rotated an amount equal to the magnetic variation.

The usual technique for plotting a course includes laying out a line of course on the chart and using a parallel rule device to translate this course until it overlies the compass rose so that the magnetic direction of the course, as well as the true direction of the course, can be determined. The procedure is somewhat inconvenient since it requires the repetitive translation of the course by means of the parallel rule until the compass rose is overlaid. This operation is particularly awkward when a small boat is operated under adverse conditions of weather and sea. Various devices, have, in the past, been proposed and employed for carrying out this operation more conveniently. One such device includes a pair of transparent disks fastened at a common axis to permit rotation of one relative to the other, with each of the disks being divided into a 360° scale and further including a narrow straightline piece, also pivoted at the common axis. In operation, this device is placed overlying the plotted course with the zero degree mark on one of the disks designated as true north being aligned with true north on the chart and the other disk being rotated such that its zero degree marker, representing magnetic north, is rotated the correct number of degrees representing the magnetic variation for that chart, as displayed on the compass rose for that chart. The narrow straightline piece is then aligned along the direction of course and an axial center line along the narrow straightline piece, provides a reading from one disk of the magnetic heading and from the other of the true heading.

To perform this operation, it is necessary to have the axis of the navigational aid device superimposed on one of the meridians of longitude, in order to align the device with true north.

SUMMARY OF THE INVENTION

It is an object of the present invention to provide a navigational computer permitting the easy plotting of courses on marine charts and further including means for distance scaling with the same device.

It is another object of this invention to provide a computer to plot a position fix using two or more navigational aids and may even be used on the logarithmic scale found on most nautical charts to solve time/-speed/distance problems. Thus, it replaces the two basic tools of nautical navigation, parallel rules and dividers with one device.

Broadly speaking, the present invention includes a transparent baseplate having a circular scale imprinted at one end and having rectangular straightedge sides at the opposite end with a grid inscribed on the entire surface of the baseplate, scaled so that every fourth line is equal to the distance of one nautical mile on a 1:80,000 scale chart. A transparent disk is rotatably connected at the center of the circular scale on the baseplate and a second circular scale concentric with the first is imprinted on the transparent disk. An elongated bar member of dimension substantially equal to the diameter of the transparent disk is also pivotally connected at the center of the two circles. The two circular scales form a compass rose with the scale on the disk being able to be rotated to provide for the variance between magnetic north and true north. Because of the straightedges and grid, the device can be readily aligned with either the latitudinal or longitudinal markings on any marine chart and can therefore be placed so that the bar member with the axial line can be superimposed directly on the course, with the scale readings providing for both magnetic and true course headings.

DESCRIPTION OF PARTICULAR EMBODIMENT

Figure 1:
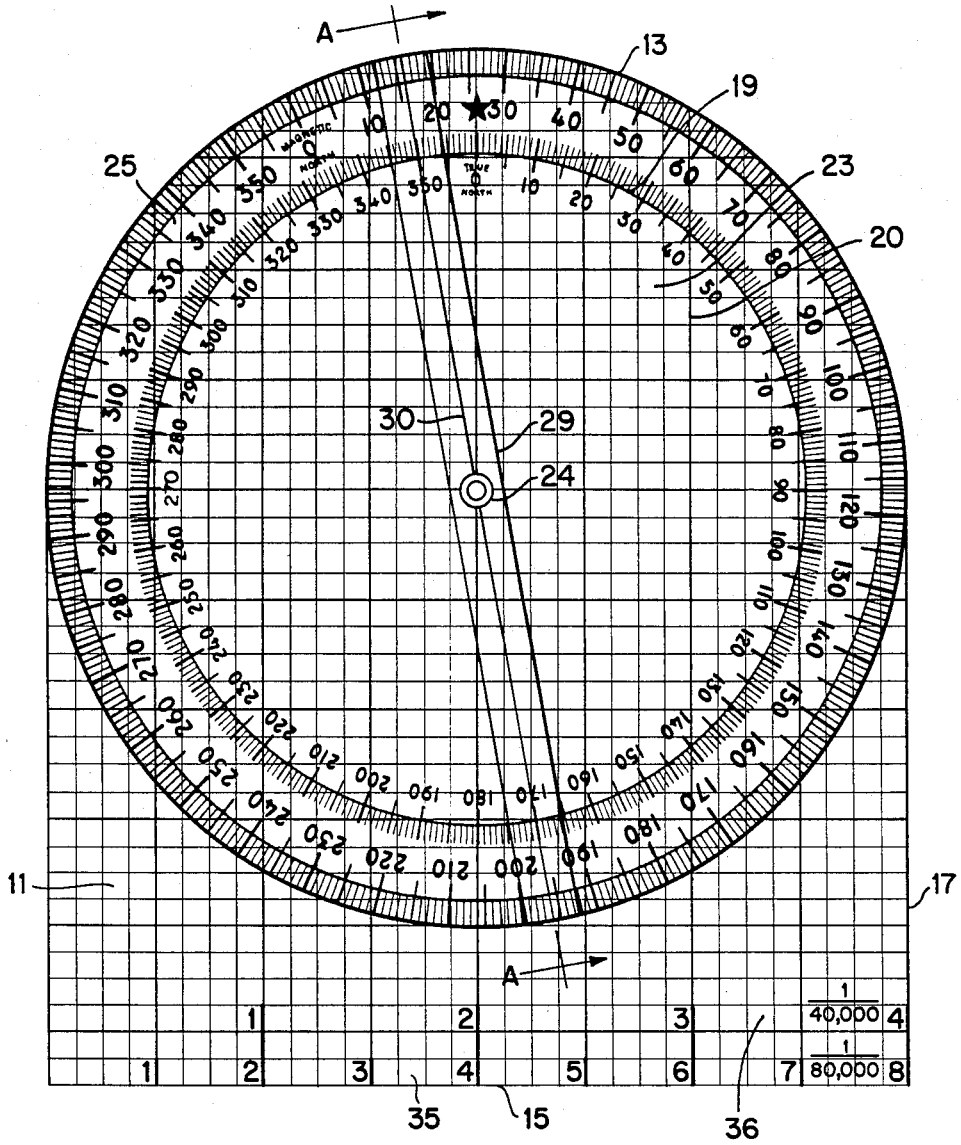
FIG. 1 is an illustration in plan view of a course and heading computer constructed in accordance with the principles of this invention.

The computer illustrated in FIG. 1 includes a transparent baseplate member 11, which can conveniently be formed of a thin sheet of a polymeric material such as polyethylene. As illustrated, it is formed such that it has a semicircular edge 13 at one end and a rectangular shape having straight sides 15 and 17 at the other end, with the side 15 having a dimension equal to the diameter of the semicircle 13. At the end of the baseplate having the semicircular edge, a 360° scale 19 is imprinted with the zero degree marking at the halfway point of the semicircular edge. A rectilinear grid 20 is inscribed on the baseplate 11 at a scale for which every fourth line equals one nautical mile on a 1:80,000 scale chart. A transparent disk member 23, typically formed of the same material as the baseplate, is rotatedly attached at pivot point 24 to the center of the scale in the baseplate 11. The diameter of the disk 23 is substantially equal to the diameter of the semicircular edge. A second 360° scale 25 is imprinted on the periphery of the disk member 23 and, as shown, lies concentrically beyond the scale on the baseplate, the two scales together forming a compass rose. An elongage bar member 29 has a length equal to the diameter of the disk 23 and is rotatably attached to the baseplate 11 at the center of the two circular scales. The bar member 29 has inscribed along it an axial line 30.

Figure 2:
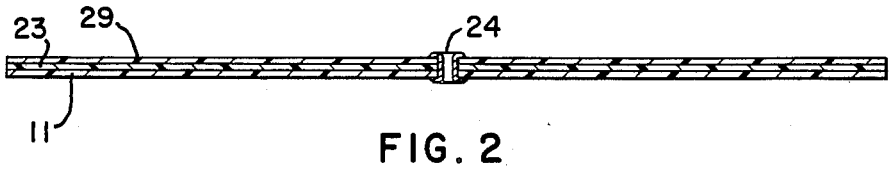
FIG. 2 is an illustration in cross sectional view taken along the line A—A of the computer of FIG. 1.

As illustrated more specifically in FIG. 2, the disk 23 overlies the baseplate 11 and the bar member 29 overlies the disk 23.

The device so described can conveniently be employed with a marine navigational chart to determine course and heading, taking into account the magnetic variance. For example, if a course is plotted between two points on the chart, the computer device is placed on the chart such that either the straightedge or grid on the width of the baseplate is aligned with a parallel of latitude or one of the other straightedges is aligned with a meridian of longitude, or the grid lines 20 are so aligned, thereby aligning the zero degree marking on the fixed scale of the baseplate with true north. The rotatable disk 23 is then rotated such that the zero degree marking on its scale varies from the zero degree marking on the fixed scale of the baseplate 11 by an amount exactly equal to the magnetic variance imprinted on the chart. The bar member 29 is then rotated so that the axial line 30 is precisely overlying the plotted course. Both the true heading and the magnetic heading can then be determined by reading the baseplate scale and the rotatable disk scale respectively.

It should be noted that the width straightedge of the baseplate is marked with scales 35 and 36, corresponding to eight nautical miles on a 1:80,000 scale chart and four miles on a 1:40,000 scale chart, respectively, and thus can be employed to determine the nautical miles along a course from point to point.

It should be noted that this device can also be used to secure a position fix by taking compass bearings on navigational aids from the boat using a peloris or hand held compass. Then, with the device still set for local variation, move the pointer 30 to the relative magnetic compass bearing taken, and, overlaying the pointer on the navigational aid with the computer aligned to True North, a pencil mark can be made on the chart through the center of the compass. A straight line is drawn from the navigational aid to this mark using the straightedge of the base plate 11. This procedure is repeated using another navigational aid and where the lines cross is the position of the boat. Further, the scale on the straightedge of the base plate can be used on the logarithmic scale found on most nautical charts to solve time/-speed/distance problems.

It is apparent that, with the device of this invention, course headings can be quickly determined, even under adverse weather and sea conditions, since it is only necessary to overlay the computer over the course plotted on the chart without the necessity of translating that course by means of parallel rules to an imprinted compass rose on the chart. In contrast to prior art devices, the inclusion of a grid in conjunction with the straightedges and the rectangular portion of the baseplate permits the computer to be aligned with true north, either by means of longitudinal meridian or a latitude parallel.

If the circular scale markings on the computer are imprinted red, they will provide color contrasting legends to those imprinted on the charts for greater ease of reading.

What is claimed is:

1. A course and heading computer for use with marine charts, comprising a transparent planar baseplate having a semicircular edge, defining a semicircle with a center and a diameter, at one end joined with rectangular straight edges at the opposite end, including a first straightedge opposite said semicircular edge and equal in length to the diameter of said semicircle, a 360° circular scale imprinted on said baseplate with its center at the center of said semicircle, wherein said baseplate has a scaled rectilinear grid with lines parallel to said straightedges imprinted thereon to assure quick, accurate alignment with either the latitudinal or longitudinal markings on a marine chart, a transparent disk member rotatably attached at its center to the center of said semicircle, said disk member having a 360° scale imprinted around its periphery, the scale imprinted on said baseplate and the scale printed on said disk member being concentric with one another to form a compass rose, the zero degree point of said base member scale being located half way around the perimeter of said semicircle, and a bar member rotatably attached at its center to the center of said semicircle, said bar member overlaying said transparent disk, said bar member having an axial line inscribed thereon.

2. A computer in accordance with claim 1 wherein said first straightedge has imprinted thereon at least one scale corresponding to the scale units of marine charts.

3. A computer in accordance with claim 1 wherein said scales are imprinted in red to provide distinction between them and imprintings on said marine chart.

* * * * *